US008291657B2

(12) United States Patent
White

(10) Patent No.: US 8,291,657 B2
(45) Date of Patent: Oct. 23, 2012

(54) BALLISTIC/BLAST RESISTANT WINDOW ASSEMBLY

(75) Inventor: William Collins White, Cicero, NY (US)

(73) Assignee: Defenshield, Inc., East Syracuse, NY (US)

( * ) Notice: Subject to any disclaimer, the term of this patent is extended or adjusted under 35 U.S.C. 154(b) by 631 days.

(21) Appl. No.: 12/115,225

(22) Filed: May 5, 2008

(65) Prior Publication Data

US 2012/0159881 A1 Jun. 28, 2012

Related U.S. Application Data

(60) Provisional application No. 60/916,076, filed on May 4, 2007.

(51) Int. Cl.
*E06B 3/00* (2006.01)
*E06B 9/00* (2006.01)
*E06B 3/32* (2006.01)

(52) U.S. Cl. ..... 52/208; 52/656.5; 109/49.5; 109/75; 109/77; 49/463; 49/504; 89/36.02; 89/36.04; 89/905; 89/937

(58) Field of Classification Search ..... 52/204.1, 52/205.5, 208, 656.2, 656.5; 89/36.04, 36.02, 89/36.08, 36.15, 905, 937; 109/49.5, 75, 109/77; 49/504, 463
See application file for complete search history.

(56) References Cited

U.S. PATENT DOCUMENTS 1,203,291 A 10/1916 White
1,212,463 A 1/1917 Doran
1,730,781 A * 10/1929 Monis ..... 160/92
1,847,419 A 3/1932 Wise
2,430,059 A * 11/1947 Krantz ..... 49/451
3,213,810 A 10/1965 Powers, Jr.
3,262,227 A 7/1966 Pentecost
3,453,929 A 7/1969 Betzold et al.
3,762,345 A 10/1973 Sgariglia et al.
3,774,363 A * 11/1973 Kent ..... 52/204.597
3,933,346 A 1/1976 Carver
3,968,809 A 7/1976 Beavers
4,112,645 A * 9/1978 Greenfield ..... 52/209
4,245,566 A * 1/1981 Shimansky et al. ..... 109/49.5
4,351,247 A 9/1982 Clark
4,430,831 A * 2/1984 Kemp ..... 52/204.53

(Continued)

FOREIGN PATENT DOCUMENTS

CA 1105324 A1 7/1981

(Continued)

OTHER PUBLICATIONS

U.S. Appl. No. 12/354,304: non-final office action, dated Apr. 20, 2012.

(Continued)

*Primary Examiner* — Brian Glessner
*Assistant Examiner* — Charissa Ahmad
(74) *Attorney, Agent, or Firm* — Woodcock Washburn LLP

(57) ABSTRACT

An attack-resistant window assembly that can be easily maintained without requiring the use of tools. The attack-resistant window assembly includes a slidable plate for securing the attack-resistant pane into the window assembly. The window assembly also has ballistic-resistant armor around the peripheral sides of the ballistic-resistant pane to prevent bullets from exiting the peripheral sides of the ballistic-resistant pane and coming into the space on the protected side of the window assembly.

16 Claims, 7 Drawing Sheets

U.S. PATENT DOCUMENTS

| | | | | | |
|---|---|---|---|---|---|
| 4,434,579 | A | * | 3/1984 | Murphy | 49/63 |
| 4,454,691 | A | * | 6/1984 | Mitchell | 52/202 |
| 4,630,411 | A | * | 12/1986 | Salzer | 52/1 |
| 4,771,673 | A | | 9/1988 | Miller | |
| 4,785,969 | A | | 11/1988 | McLaughlin | |
| 4,856,575 | A | * | 8/1989 | Wells | 160/353 |
| 4,878,314 | A | * | 11/1989 | Blockinger | 49/381 |
| 4,991,369 | A | * | 2/1991 | Lamb | 52/476 |
| 5,012,610 | A | * | 5/1991 | Carballo | 49/57 |
| 5,046,284 | A | * | 9/1991 | Harper | 49/463 |
| 5,052,850 | A | | 10/1991 | Bishop | |
| 5,165,189 | A | * | 11/1992 | Besal | 49/463 |
| 5,174,553 | A | | 12/1992 | Challis | |
| 5,242,207 | A | * | 9/1993 | Carson et al. | 296/146.15 |
| 5,271,311 | A | * | 12/1993 | Madden, Jr. | 89/36.08 |
| 5,497,588 | A | * | 3/1996 | Martin et al. | 52/208 |
| 5,529,366 | A | * | 6/1996 | Gold | 296/96.21 |
| 5,594,193 | A | * | 1/1997 | Sheridan | 89/36.08 |
| 5,603,190 | A | * | 2/1997 | Sanford | 52/202 |
| 5,644,881 | A | * | 7/1997 | Neilly | 52/455 |
| 5,657,590 | A | | 8/1997 | Digman et al. | |
| 5,666,773 | A | | 9/1997 | Librande et al. | |
| 5,765,325 | A | * | 6/1998 | DeBlock | 52/204.5 |
| 5,857,730 | A | * | 1/1999 | Korpi et al. | 296/146.1 |
| 5,906,070 | A | * | 5/1999 | Boerhave | 49/207 |
| 5,907,929 | A | * | 6/1999 | Poma et al. | 52/78 |
| 5,986,211 | A | * | 11/1999 | Greer et al. | 174/61 |
| D431,082 | S | | 9/2000 | Jaros | |
| 6,230,455 | B1 | * | 5/2001 | Arehart et al. | 52/202 |
| 6,302,010 | B1 | | 10/2001 | Holler | |
| 6,551,011 | B1 | | 4/2003 | Valentine | |
| 6,581,668 | B1 | * | 6/2003 | Oakley | 160/380 |
| 6,622,607 | B1 | | 9/2003 | Miller | |
| 6,626,314 | B1 | | 9/2003 | McHenry et al. | |
| 6,694,683 | B2 | * | 2/2004 | Anderson et al. | 52/204.5 |
| 6,698,690 | B2 | | 3/2004 | Novak et al. | |
| 6,907,811 | B2 | | 6/2005 | White | |
| 6,931,810 | B2 | * | 8/2005 | Beaudoin et al. | 52/455 |
| 6,964,131 | B2 | * | 11/2005 | Herrmann et al. | 49/193 |
| 7,040,062 | B2 | * | 5/2006 | Emek | 52/204.62 |
| 7,063,374 | B1 | * | 6/2006 | Cameron | 296/152 |
| 7,080,874 | B2 | * | 7/2006 | Farrar et al. | 296/146.16 |
| 7,107,736 | B2 | * | 9/2006 | Barnard | 52/745.15 |
| 7,165,364 | B2 | * | 1/2007 | Inelli | 52/208 |
| 7,232,181 | B2 | * | 6/2007 | Schmucker | 296/201 |
| 7,789,010 | B2 | * | 9/2010 | Allor et al. | 89/36.03 |
| 7,823,498 | B2 | * | 11/2010 | Schneider et al. | 89/36.08 |
| 8,015,910 | B1 | | 9/2011 | Fuqua et al. | |
| 2002/0095885 | A1 | | 7/2002 | Sampson | |
| 2002/0184839 | A1 | * | 12/2002 | Emek | 52/202 |
| 2004/0058125 | A1 | * | 3/2004 | Gonzalez | 428/122 |
| 2004/0211133 | A1 | * | 10/2004 | Berger, Jr. | 52/204.1 |
| 2004/0216593 | A1 | | 11/2004 | Pastrnak et al. | |
| 2005/0055906 | A1 | * | 3/2005 | Barnard | 52/204.1 |
| 2005/0072073 | A1 | * | 4/2005 | Inelli | 52/204.1 |
| 2005/0138872 | A1 | * | 6/2005 | Farrar et al. | 52/204.1 |
| 2005/0238880 | A1 | * | 10/2005 | Labock | 428/412 |
| 2006/0005481 | A1 | * | 1/2006 | Ouellette | 52/204.1 |
| 2006/0254947 | A1 | | 11/2006 | Rogers | |
| 2007/0000189 | A1 | | 1/2007 | Chang | |
| 2007/0011962 | A1 | | 1/2007 | Erskine | |
| 2007/0180981 | A1 | | 8/2007 | Tapp et al. | |
| 2007/0193213 | A1 | | 8/2007 | Nanayakkara | |
| 2007/0243015 | A1 | | 10/2007 | Yodock | |
| 2007/0296229 | A1 | | 12/2007 | Chauvin et al. | |
| 2008/0016799 | A1 | * | 1/2008 | Sayer | 52/204.1 |
| 2008/0092731 | A1 | * | 4/2008 | Hall | 89/36.04 |
| 2008/0271652 | A1 | | 11/2008 | White et al. | |
| 2009/0277094 | A1 | * | 11/2009 | Ward | 49/413 |
| 2009/0277109 | A1 | * | 11/2009 | Taylor et al. | 52/208 |
| 2009/0277110 | A1 | * | 11/2009 | Cashman | 52/213 |
| 2010/0242714 | A1 | * | 9/2010 | Piscitelli et al. | 89/36.02 |
| 2010/0251635 | A1 | * | 10/2010 | Barnard et al. | 52/127.6 |

FOREIGN PATENT DOCUMENTS

| | | | | |
|---|---|---|---|---|
| DE | 7826689 | U1 | | 2/1979 |
| EP | 292274 | | | 11/1988 |
| EP | 292274 | A2 | * | 11/1988 |
| FR | 2701996 | A | | 9/1994 |
| FR | 2848599 | A | | 6/2004 |
| JP | 06058055 | | | 3/1994 |
| JP | 06058055 | A | * | 3/1994 |
| WO | WO 2009/020681 | | | 2/2009 |
| WO | WO 2009/091887 | | | 7/2009 |
| WO | WO 2011/002538 | | | 1/2011 |

OTHER PUBLICATIONS

International Patent Application No. PCT/US10/30588: International Search report and Written Opinion dated Apr. 9, 2010, 17 Pages.

International Patent Application No. PCT/US09/31097: International Search report dated Mar. 17, 2009, 1 Page.

* cited by examiner

BALLISTIC/BLAST RESISTANT WINDOW ASSEMBLY

RELATED APPLICATION

The present application claims priority to U.S. provisional patent application No. 60/916,076, filed on May 4, 2007; all of the foregoing patent-related document(s) are hereby incorporated by reference herein in their respective entirety(ies).

BACKGROUND OF THE INVENTION

1. Field of the Invention

The present invention relates to attack-resistant panes (see DEFINITIONS section) and to window assemblies (see DEFINITIONS section) including attack resistant pane(s).

2. Description of the Related Art

Attack-resistant panes are conventional. An attack resistant pane may be ballistic resistant, blast resistant, or both. The degree of ballistic resistance is sometimes rated under one of the following standards: (i) "Ballistic Resistant Protective Materials NIJ Standard 0108.01" by the National Institute of Justice of the U.S. Department of Justice; and (ii) "Bullet-resisting Equipment UL 752" by Underwriters' Laboratories. Both of these standards are published and available online. The degree of blast resistance is sometimes rated under the following standard: GSA Testing Standard (also published and available online.) It is noted that these standards of ballistic resistance and blast resistance are applicable not just to attack resistant panes, but more broadly to any attack resistant panel, such as an opaque panel.

Conventionally, attack resistant panes are made of acrylic or glass, often reinforced with polycarbonate. Conventionally, attack resistant panes are usually a couple inches thick, but may be thinner depending on material used, degree of blast resistance required, degree of ballistic resistance desired and application. Conventional applications of attack resistant panes include window assemblies (see DEFINITIONS section) with attack-resistant pane(s).

US published patent application 2002/0095885 ("Sampson") discloses a force resistant door and window framing system with frame sections that are: (i) blast resistant; (ii) forced entry resistant; and (iii) ballistic resistant. Each frame section is formed of a single, basic monolithic, homogeneous steel component.

US published patent application 2007/0011962 ("Erskine") discloses various blast-resistant and ballistic-resistant window assemblies.

Description Of the Related Art Section Disclaimer: To the extent that specific publications are discussed above in this Description of the Related Art Section, these discussions should not be taken as an admission that the discussed publications (for example, published patents) are prior art for patent law purposes. For example, some or all of the discussed publications may not be sufficiently early in time, may not reflect subject matter developed early enough in time and/or may not be sufficiently enabling so as to amount to prior art for patent law purposes. To the extent that specific publications are discussed above in this Description of the Related Art Section, they are all hereby incorporated by reference into this document in their respective entirety(ies).

BRIEF SUMMARY OF THE INVENTION

The present invention is directed to window assemblies having attack-resistant panes, where the hardware of the assembly is structured so that the attack-resistant pane can be inserted, removed and replaced by a person working only on a protected side of the window assembly, without need for the person to go to the attack side of the window assembly. Preferably, the hardware is further structured so that the attack-resistant pane can be inserted, removed or replaced with out the use of tools. Preferably, the assembly includes a frame member and a sliding plate, where the sliding plate: (i) slides into the frame member to secure the pane; and (ii) slides out of the frame member to allow the pane to be inserted into the frame member.

The present invention is also directed to a window assembly including a ballistic-resistant (see DEFINITIONS section) pane and a peripheral armor portion. The peripheral armor portion is ballistic resistant and is located at least substantially around a peripheral side of the pane. In this way, bullets that enter the attack-side major surface of the pane cannot escape through the peripheral side of the pane and cannot harm people and things on the protected side of the window assembly. This can be important because, while ballistic-resistant panes are resistant to bullets travelling into the attack side major surface, through the body of the pane, and out of the protected-side major surface, they may not always protect against shots that enter the attack-side major surface and leave through a peripheral surface for some reason (for example, angled shot or deflected bullet).

Various embodiments of the present invention may exhibit one or more of the following objects, features and/or advantages:

(1) provides protection to an individual (for example, inside a station) without restricting visibility;

(2) safer pane installation and/or repair because pane can be replaced exclusively from the protected side;

(3) quicker pane installation and/or repair because tools are not required to remove and/or secure the attack-resistant pane within the assembly;

(4) suitable for use in a protective station, protective shelter and/or guard house; and/or (5) a greater degree of protection from bullets because peripheral armor on the pane prevents "freak" shots and angled shots from penetrating through the window assembly; and/or (6) a greater degree of protection from bullets because of redundant layers of ballistic-resistant with respect to certain potential bullet paths through the window assembly.

According to an aspect of the present invention, an attack-resistant window assembly defines an attack side and a protected side and includes an attack-resistant pane, a base frame, a flange and a rear panel. The attack-resistant pane has an attack-side major surface, a protected-side major surface and a peripheral edge. The base frame includes a pane supporting portion, a mounting portion, a rear panel and a flange. The pane supporting portion is at least partially located beneath the attack-resistant pane and is adapted to support the pane against gravitational forces. The mounting portion is adapted to allow the assembly to be mounted to a structure. The flange defines a volume between the protected-side major surface and the flange. The rear panel is sized and shaped to be slidable between a first position spaced away from the base frame, and a second position on top of the pane supporting portion in the volume defined by the flange. In this way, the pane is secured in the assembly when the rear panel is in the second position.

According to a further aspect of the present invention, a ballistic-resistant window assembly defines an attack side and a protected side. The assembly includes a ballistic-resistant pane and a peripheral armor portion. The attack-resistant pane has an attack-side major surface, a protected-side major surface and a peripheral edge. The peripheral armor portion is located around the peripheral edge of the pane and is ballistic-resistant.

According to a further aspect of the present invention, a ballistic-resistant window assembly defines an attack side and a protected side. The assembly includes a ballistic resistant pane, a base frame, a rear panel and a peripheral armor portion. The ballistic-resistant pane has an attack-side major surface, a protected-side major surface and a peripheral edge. The base frame includes a pane supporting portion, a mounting portion and a flange. The pane supporting portion extends at least substantially around the peripheral edge of the pane and secures the pane against motion in directions parallel to its major surfaces. The mounting portion is adapted to allow the assembly to be mounted to a structure. The flange defines a volume between the protected-side major surface and the flange. The rear panel is sized and shaped to be slidable between a first position spaced away from the base frame, and a second position on top of the pane supporting portion in the volume defined by the cut-out. In this way, the pane is secured in the assembly when the rear panel is in the second position. The peripheral armor portion is located between the pane supporting portion and the peripheral edge. The peripheral armor portion is ballistic-resistant.

BRIEF DESCRIPTION OF THE DRAWINGS

The present invention will be more fully understood and appreciated by reading the following Detailed Description in conjunction with the accompanying drawings, in which.

DETAILED DESCRIPTION OF THE INVENTION

A ballistic/blast resistant window assembly of an embodiment of the present invention can provide protection to an individual (e.g., inside a station) without restricting visibility, be maintained from the safe side (e.g., inside) of a station, and may be quickly broken down and replaced without the use of tools for ease of maintenance and without placing the individual replacing the ballistic/blast resistant window assembly (or any other individual inside the station) in harms way, is provided.

Figure 1:
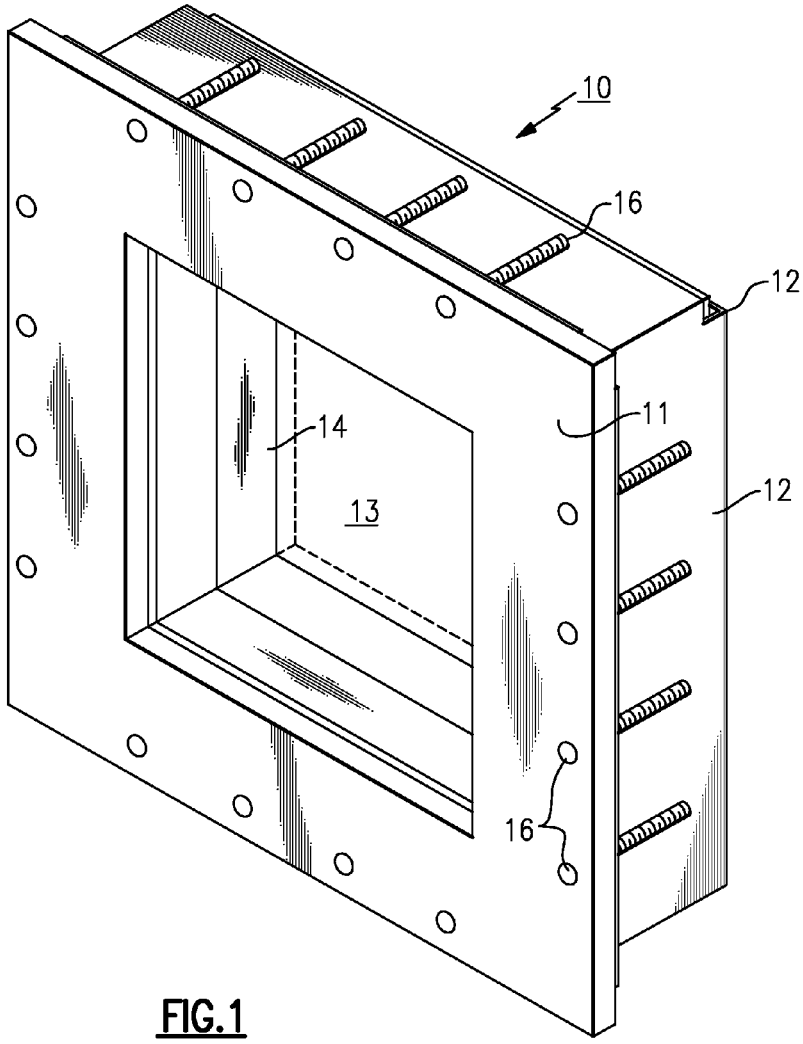
FIG. 1 is a perspective view showing the attack-side of a first embodiment of an attack-resistant window assembly according to the present invention.
Figure 2:
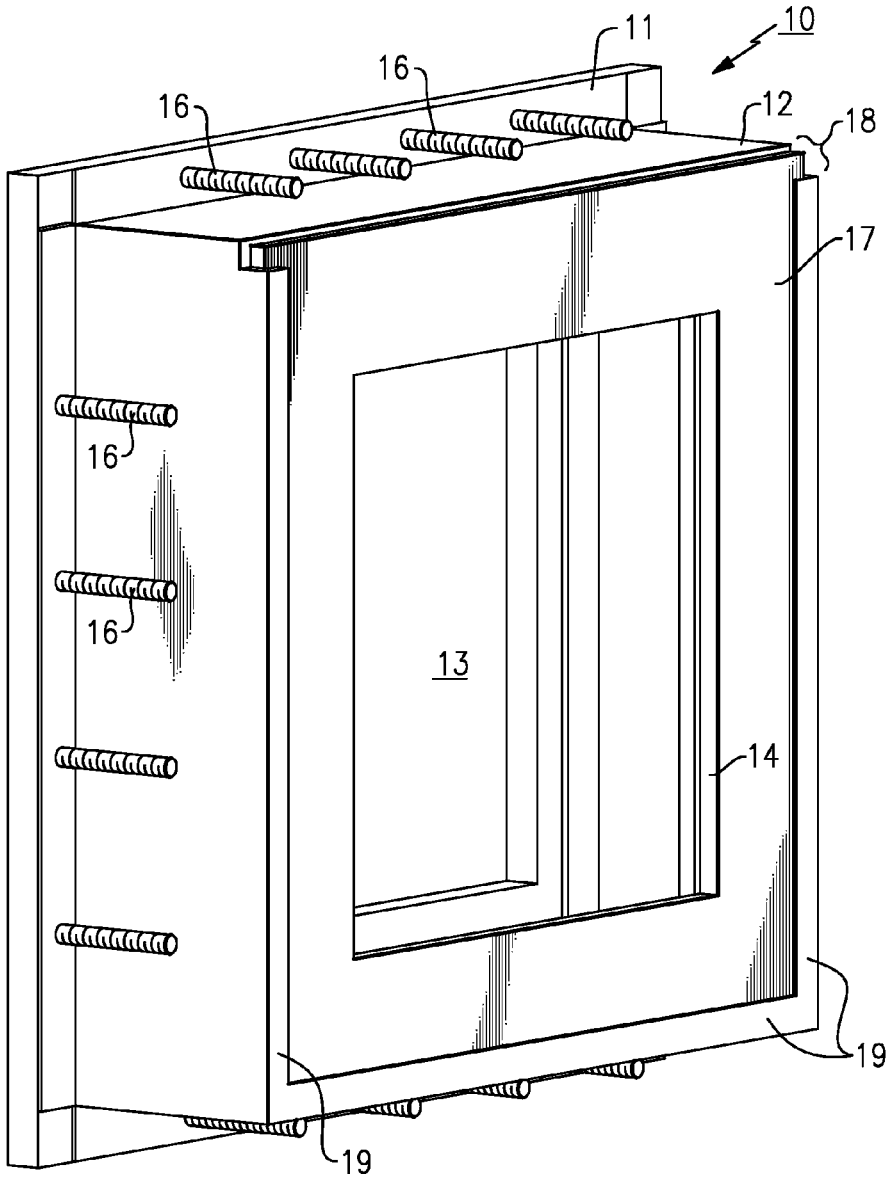
FIG. 2 is a perspective view that shows the protected-side of the first embodiment window assembly.
Figure 3:
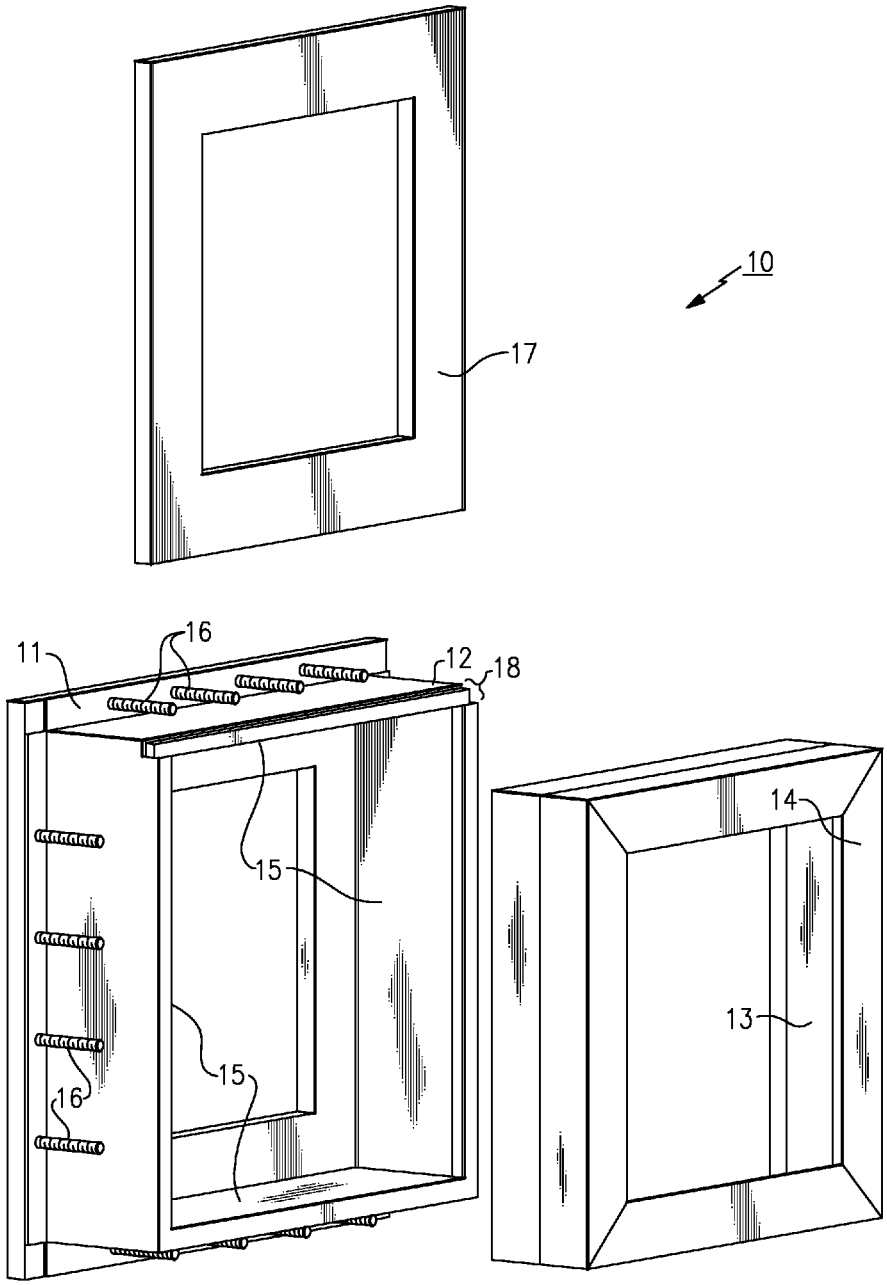
FIG. 3 is an exploded perspective view of the first embodiment window assembly.

As shown at FIGS. 1 to 3, an attack-resistant window assembly 10 includes: forward armor frame panel 11; base frame 12; attack-resistant pane 13; gasketing 14; base frame armor panels 15; threaded studs 16; rear armor panel 17; and cut-out 18 (which is defined by the flange 19 portion of the base frame). Although the base frame is shown as a single part, this is not necessarily required. Also while the preferred shapes are shown for the components of assembly 10, variations on this geometry are within the scope of the present invention.

The forward armor frame panel, pane, base frame armor panels and rear armor panel (collectively, the "armor panels") are all preferably attack resistant and also preferably ballistic-resistant. The armor panels may be composed of various attack-resistant materials, such as metal, plastic, ceramic or a composite material. The pane is composed of an at least substantially transparent attack-resistant material, such as plastic, acrylic, glass, polycarbonate-reinforced acrylic and/or polycarbonate reinforced glass. Some trade names of suitable materials (which may be registered trademarks in some jurisdictions) are: Armortex; Frag-Stop; Hygard and Acryshield. Manufacturers of suitable attack-resistant pane materials include: North American Specialty Glass, Trumbauersville, Pa. USA and SABIC Innovative Plastics (formerly GE Plastics).

As shown in FIG. 3, the set of base frame armor panels 15 line the top, bottom and sides of the base frame 12 to protect from oblique projectiles and forces. When the window assembly is fully assembled, the base frame armor panels surround the peripheral sides of the pane, although, in this embodiment, gasketing 14 is interposed between the peripheral sides of the pane and the base frame armor panels. In other words, the base frame armor panels are not required to be directly adjacent to the peripheral sides of the pane, but they should be close enough to prevent bullets from escaping through the volume between the peripheral sides of the pane and the base frame armor panels. Although assembly 10 includes four separate base frame armor panels, more or fewer separate pieces could be used so long as the peripheral side of the pane is completely surrounded. In alternative embodiments, where the pane is not rectangular, the base frame armor panels should follow the shape of the perimeter of the major surfaces of the pane. In this embodiment, the peripheral side of the pane and base frame armor panels are perpendicular to the major surfaces of the pane, but this is not necessarily required.

Figure 4:
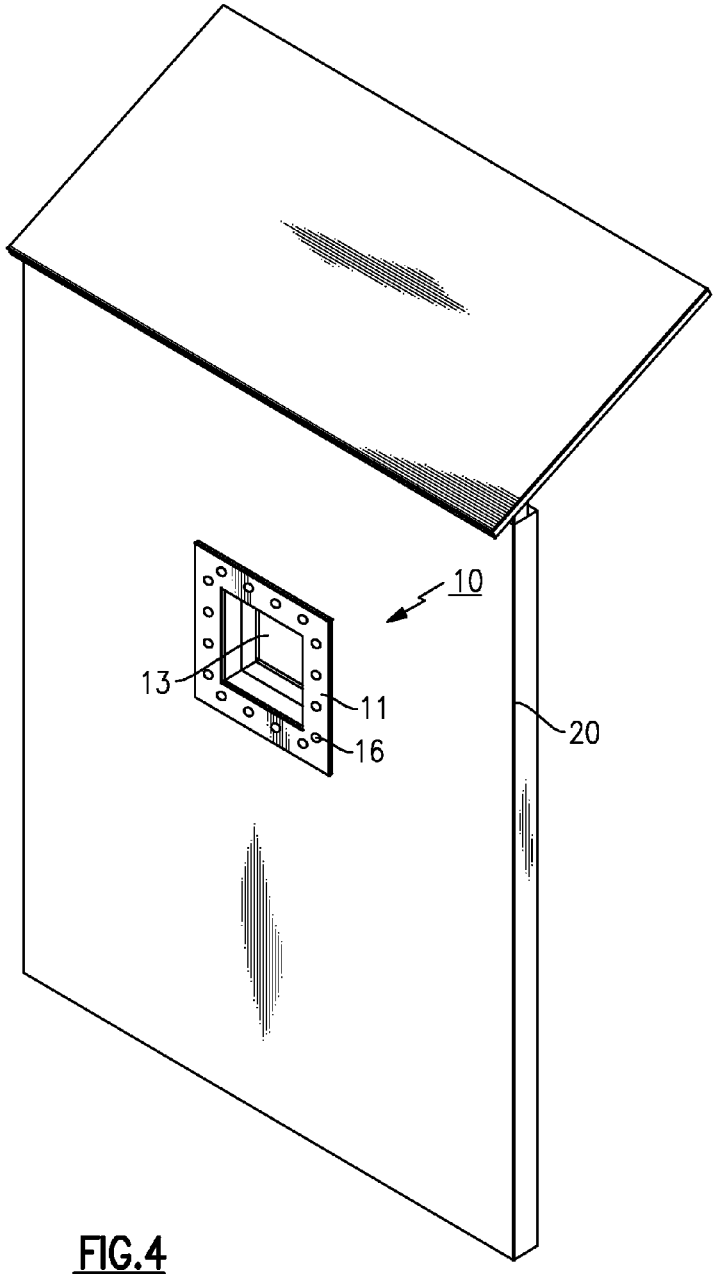
FIG. 4 is a perspective view, taken from the attack side, of a portion of a building including the first embodiment window assembly.
Figure 5:
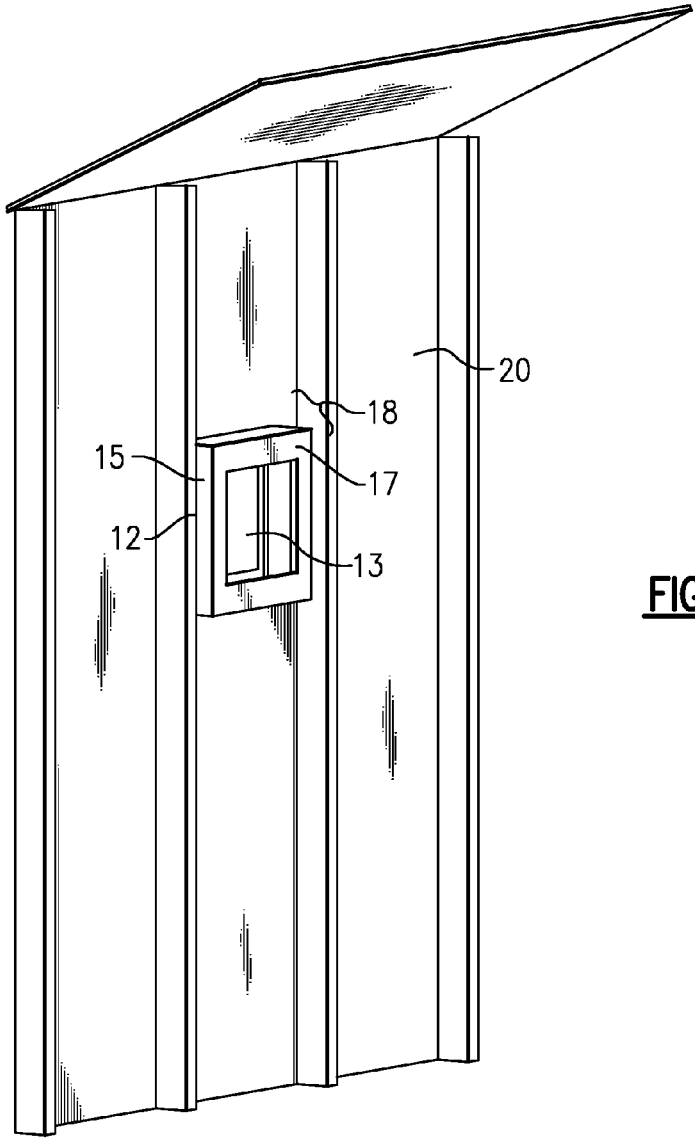
FIG. 5 is a perspective view, taken from the protected side, of a portion of a building including the first embodiment window assembly.
Figure 6:
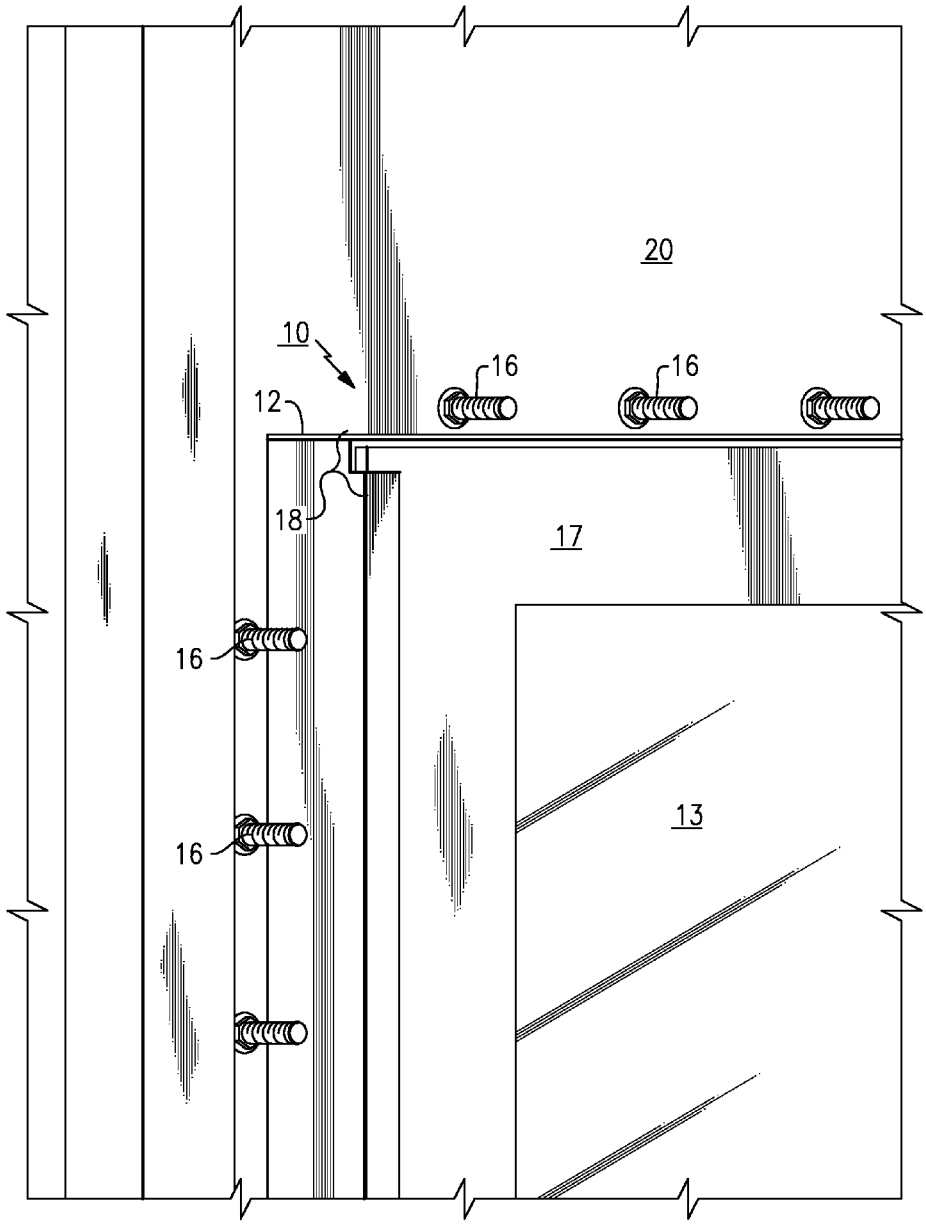
FIG. 6 is a perspective view, taken from the protected side, of a portion of a building and a portion of the first embodiment window assembly.

A series of bolts or threaded studs 16 (not all numbered), and/or sealant (not shown) around the perimeter of the forward armor frame panel 11 allow for the window assembly to be secured to a station or shelter (not shown, but see, FIGS. 4-6). The base frame 12 is held in place by the forward armor plate 11 secured to the outside face of a station or shelter (not shown, but see, FIGS. 4-6).

As shown in FIG. 2, the series of bolts or threaded studs 16 (not all numbered) are located at intervals around the perimeter of the forward armor frame panel. Alternatively, other attachment hardware could be used, but it must be strong enough to provide the kind and degree of attack-resistance required in a given application. A rear armor panel 17 that was slid into a cut-out 18 in the top of the base frame 12, secures all of the components of the ballistic/blast resistant window assembly 10 and is held in place by gravity.

More specifically, the rear panel is slidable between: (i) a first position where it is separated from the window assembly; and (ii) a second position where it is in the assembly resting on a bottom portion of base frame 12. In the firs position, the pane and gasket may be removed from and inserted into the rest of the assembly. In the second position, the assembly is secured. More specifically, flange 19 holds the rear panel, gasketing and pane securely against the front armor panel with respect to the direction perpendicular to the major surfaces of the pane, thereby protecting persons on the protected side of the assembly from blasts and/or ballistics originating on the attack side of the assembly. Because the rear panel allows full access to the volume containing the pane from the protected side of the assembly, the pane can be repaired or replaced from the protected side without the need for anyone to venture out to the attack side (where unsafe conditions may exist). The rear panel is preferably slidable between these two positions without the use of tools, but this is not necessarily required in all embodiments of the present invention.

Window assembly 10, as described with reference to FIGS. 1 to 3, can be attached to and used with a protective station or shelter (for example, a guard house), as illustrated in FIGS. 4-6. FIG. 4 shows an attack side view of window assembly 10 in use as part of a station wall 20. FIG. 6 shows an enlarged protected side view of window assembly 10 attached to and in use with a station wall 20.

As mentioned above, if, at any time, any or all serviceable components of the window assembly need to be replaced (for example, because of damage), these serviceable components can be replaced by an individual from the protected side of the window assembly. As mentioned above, the rear armor panel 17 can be removed (slid out of the cut-out 18 in the top of the base frame 12) as easily as it was slid into the cut-out 18 in the top of the base frame 12. Following the removal of the rear armor panel 17, the pane 13 surrounded by gasketing material 14 may be removed from within the base frame 12 and from the back side of the ballistic/blast resistant window assembly 10.

When the assembly is fully assembled, the base frame armor plate that is over the top peripheral side of the pane is secured between the gasketing on the top side of the pane and the top portion of the base frame. When the pane is being removed, this top base frame armor panel is removed after the rear panel is removed to allow access to it, but before the pane and gasketing are removed from the base frame. When the assembly is being assembled, the top base frame armor plate is laid on top of the top gasketing after the pane and gasketing are in place in the base frame, but before the rear armor panel is inserted back into the cut-out.

Figure 7:
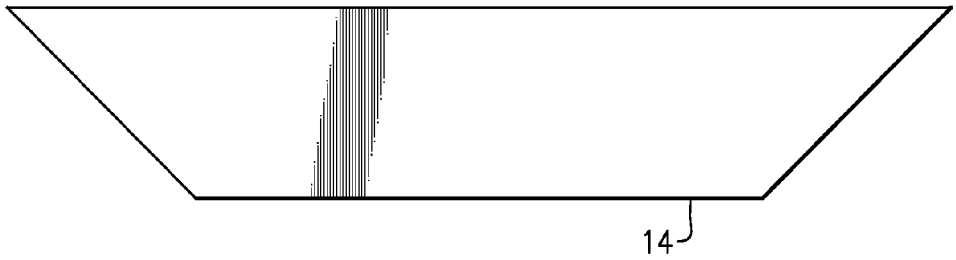
FIG. 7 is a side orthographic view of a gasketing piece for use in the present invention.
Figure 8:
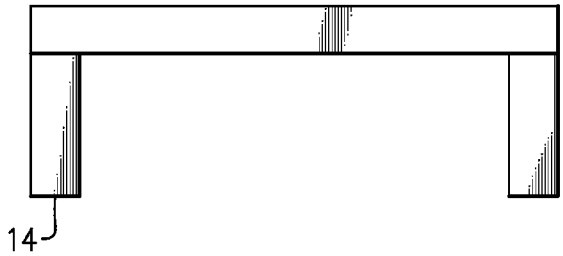
FIG. 8 is an end orthographic view of the FIG. 7 gasketing piece.

A piece of gasketing 14 is shown in FIGS. 7 and 8. One piece of this U-shaped (see FIG. 8) gasketing is located around each peripheral side of the pane. Preferably, the gasketing is made of rubber and it helps absorb shock, helps prevent damage to the edges of the attack-resistant pane and makes the pane easier to work with during installation and de-installation.

Now that the hardware of assembly 10 has been explained, it is noted that the assembly provides redundant protection with respect to certain potential bullet paths, which is especially advantageous in the ballistic-resistant embodiments of the present invention. More specifically, bullet paths near the edge of the pane, but within the perimeter of the major surfaces of the pane, are protected by the forward armor panel, the pane itself and the rear armor panel. Angled bullet paths, or non-linear bullet paths, passing through the peripheral surface of the pane are protected by the pane itself and also by the base frame armor plates. This redundant protection in the vicinity of the peripheral edges of the pane enhances the safety and reliability of window assemblies according to the present invention.

DEFINITIONS

The following definitions are provided to facilitate claim interpretation and claim construction:

Present invention: means at least some embodiments of the present invention; references to various feature(s) of the "present invention" throughout this document do not mean that all claimed embodiments or methods include the referenced feature(s).

First, second, third, etc. ("ordinals"): Unless otherwise noted, ordinals only serve to distinguish or identify (e.g., various members of a group); the mere use of ordinals implies neither a consecutive numerical limit nor a serial limitation.

Attack-resistant: Any object or portion of an object that is at least substantially resistant to ballistic and/or blast type forces; attack-resistant objects may be made of any attack-resistant material now known or to be developed in the future.

Attack-resistant pane: Any substantially transparent window that is at least substantially resistant to ballistic and/or blast type forces; attack-resistant panes include, but are not limited to bullet-proof windows, bullet-proof shields and vehicles with bullet-proof windshields; attack-resistant panes may be made of any attack-resistant pane material now known or to be developed in the future.

Ballistic-resistant: Any object or portion of an object that is at least substantially resistant to ballistic forces; ballistic-resistant objects may be made of any ballistic-resistant material now known or to be developed in the future.

Ballistic-resistant pane: Any substantially transparent window that is at least substantially resistant to ballistic forces; ballistic-resistant panes include, but are not limited to bullet-proof windows, bullet-proof shields and vehicles with bullet-proof windshields; ballistic-resistant panes may be made of any ballistic-resistant pane material now known or to be developed in the future.

Window/Window assemblies: any combination of one or more window pane and its associate framing components designed to be built into a relatively permanent structures, such as, without limitation, an exterior wall of a building, an interior wall of a building, an exterior door of a building or an interior door of a building.

To the extent that the definitions provided above are consistent with ordinary, plain, and accustomed meanings (as generally shown by documents such as dictionaries and/or technical lexicons), the above definitions shall be considered supplemental in nature. To the extent that the definitions provided above are inconsistent with ordinary, plain, and accustomed meanings (as generally shown by documents such as dictionaries and/or technical lexicons), the above definitions shall control. If the definitions provided above are broader than the ordinary, plain, and accustomed meanings in some aspect, then the above definitions shall be considered to broaden the claim accordingly.

To the extent that a patentee may act as its own lexicographer under applicable law, it is hereby further directed that all words appearing in the claims section, except for the above-defined words, shall take on their ordinary, plain, and accustomed meanings (as generally shown by documents such as dictionaries and/or technical lexicons), and shall not be considered to be specially defined in this specification. In the situation where a word or term used in the claims has more than one alternative ordinary, plain and accustomed meaning, the broadest definition that is consistent with technological feasibility and not directly inconsistent with the specification shall control.

Unless otherwise explicitly provided in the claim language, steps in method steps or process claims need only be performed in the same time order as the order the steps are recited in the claim only to the extent that impossibility or extreme feasibility problems dictate that the recited step order (or portion of the recited step order) be used. This broad interpretation with respect to step order is to be used regardless of whether the alternative time ordering(s) of the claimed steps is particularly mentioned or discussed in this document.

What is claimed is:

1. An attack-resistant window assembly defining an attack side and a protected side, the assembly comprising:

an attack-resistant pane having an attack-side major surface, a protected-side major surface and a peripheral edge;

a base frame comprising:

a pane supporting portion at least partially located beneath the attack-resistant pane and adapted to support the pane against gravitational forces, a mounting portion adapted to mount the assembly to a structure, and a flange defining an opening between the protected-side major surface and the flange; and a rear panel sized and shaped such that the rear panel is slidable between a first position spaced away from the base frame and the pane, and a second position on top of the pane supporting portion and at least partially within the opening defined by the flange such that the rear panel is positioned on the protected side relative to the pane, and abuts the protected-side major surface of the pane so that movement of the pane in a direction from the attack side toward the protected side is limited by the rear panel at least partially within the opening defined by the flange.

2. The assembly of claim 1 wherein:

the major surfaces of the attack-resistant pane are at least substantially rectangular; and the pane supporting portion extends at least substantially around a rectangular peripheral edge of the pane and secures the pane against motion in directions parallel to its major surfaces.

3. The assembly of claim 1 wherein:

the rear panel is ballistic-resistant; and the attack-resistant pane is ballistic resistant.

4. The assembly of claim 1 further comprising a front panel mechanically connected to the base frame and extending over a perimeter of the attack-side major surface, the front panel being ballistic resistant.

5. The assembly of claim 1 further comprising gasketing located between the peripheral edge and the base frame.

6. The assembly of claim 1 wherein the attack-resistant pane and the base frame are sized and shaped so that the attack-resistant pane may be removed from the base frame by a person on the protected side when the rear panel is in the first position.

7. The assembly of claim 1 wherein the flange and the rear panel are sized and shaped so that the rear panel may be slid between the first position and the second position without use of tools.

8. The assembly of claim 1 further comprising at least one ballistic-resistant armor panel located between the peripheral edge and the base frame.

9. The assembly of claim 8 further comprising gasketing located between the peripheral edge and the base frame.

10. A ballistic-resistant window assembly defining an attack side and a protected side, the assembly comprising:

a ballistic-resistant pane having an attack-side major surface, a protected-side major surface and a peripheral edge;

a base frame comprising:

a pane supporting portion extending at least substantially around the peripheral edge of the pane and securing the pane against motion in directions parallel to its major surfaces, a mounting portion adapted to allow the assembly to be mounted to a structure, and a flange defining an opening between the protected-side major surface and the flange;

a rear panel sized and shaped to be slidable between a first position spaced away from the base frame and the pane, and a second position wherein the rear panel is positioned on the protected side relative to the pane, disposed at least partially within the opening, and abuts the protected-side major surface of the pane such that movement of the pane in a direction toward the protected side is limited by the flange; and a peripheral armor portion located between the pane supporting portion and the peripheral edge, the peripheral armor portion being ballistic-resistant.

11. The assembly of claim 10 wherein the major surfaces of the ballistic-resistant pane are at least substantially rectangular; and the peripheral armor portion comprises four armor panels respectively located around four peripheral edges of the ballistic-resistant pane.

12. The assembly of claim 10 wherein the rear panel is ballistic-resistant.

13. The assembly of claim 10 further comprising a front panel mechanically connected to the base frame and extending over a perimeter of the attack-side major surface, the front panel being ballistic-resistant.

14. The assembly of claim 10 further comprising gasketing located between the peripheral edge and the base frame.

15. The assembly of claim 10 wherein the attack-resistant pane and the base frame are sized and shaped so that the attack-resistant pane may be removed from the base frame by a person on the protected side when the rear panel is in the first position.

16. The assembly of claim 10 wherein the flange and the rear panel are sized and shaped so that the rear panel may be slid between the first position and the second position without use of tools.

* * * * *